US007946268B2

(12) United States Patent
Messmer

(10) Patent No.: US 7,946,268 B2
(45) Date of Patent: May 24, 2011

(54) TWO-PART PISTON FOR AN INTERNAL COMBUSTION ENGINE

(75) Inventor: Dieter Messmer, Remseck (DE)

(73) Assignee: MAHLE International GmbH, Stuttgart (DE)

( * ) Notice: Subject to any disclaimer, the term of this patent is extended or adjusted under 35 U.S.C. 154(b) by 593 days.

(21) Appl. No.: 11/991,238

(22) PCT Filed: Aug. 31, 2006

(86) PCT No.: PCT/DE2006/001527

§ 371 (c)(1),
(2), (4) Date: Jun. 17, 2008

(87) PCT Pub. No.: WO2007/025529

PCT Pub. Date: Mar. 8, 2007

(65) Prior Publication Data

US 2009/0260593 A1 Oct. 22, 2009

(30) Foreign Application Priority Data

Sep. 1, 2005 (DE) ..... 10 2005 041 409

(51) Int. Cl.
*F02F 3/20* (2006.01)

(52) U.S. Cl. ..... 123/193.6; 92/220

(58) Field of Classification Search ..... 92/220, 92/221, 215–217, 256; 123/193.6, 41.35
See application file for complete search history.

(56) References Cited

U.S. PATENT DOCUMENTS

| | | | | |
|---|---|---|---|---|
| 1,723,823 | A | 8/1929 | Teetor | |
| 3,465,651 | A | 9/1969 | Tromel | |
| 4,185,544 | A | 1/1980 | Kolar | |
| 4,242,948 | A | 1/1981 | Stang et al. | |
| 4,375,782 | A * | 3/1983 | Schieber | 92/176 |
| 5,081,968 | A * | 1/1992 | Bruni | 123/193.6 |
| 6,829,977 | B2 | 12/2004 | Messmer | |
| 7,302,927 | B1 | 12/2007 | Scharp | |
| 2008/0121204 | A1 * | 5/2008 | Scharp | 123/193.6 |

FOREIGN PATENT DOCUMENTS

| | | |
|---|---|---|
| DE | 1 141 491 | 12/1962 |
| DE | 11 41 491 | 12/1962 |

(Continued)

OTHER PUBLICATIONS

International Search Report.

*Primary Examiner* — M. McMahon
(74) *Attorney, Agent, or Firm* — Collard & Roe, P.C.

(57) ABSTRACT

A two-piece piston for an internal combustion engine has an upper piece and a lower piece, the lower piece having an upper base part with an opening lying coaxial to the piston axis into which a pin on the upper piece is inserted. The upper piece is connected to the lower piece with a hexagonal nut screwed onto the pin. A resilient sleeve is arranged between the upper piece and the lower piece comprising an inwardly directed collar on the against which the upper face of the hexagonal nut lies and in the region facing away from the piston crown, a contact surface facing the piston crown lying on a surface on the inner side of the opening. An economically produced two-piece piston results with a resilient sleeve between both screwed piston pieces which exerts a pre-tensioning and thus provides security for the screw connection.

7 Claims, 6 Drawing Sheets

FOREIGN PATENT DOCUMENTS

Figure 1:
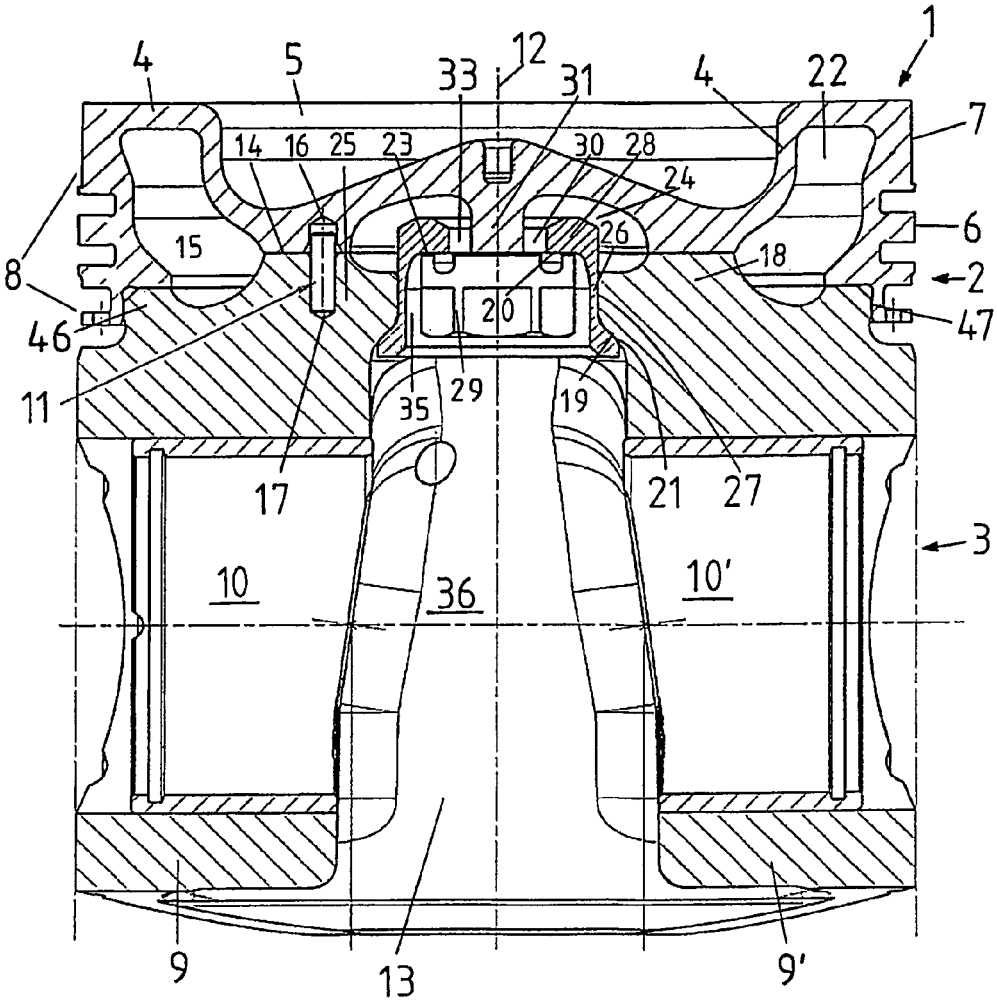

| | | |
|---|---|---|
| DE | 1 476 074 | 3/1970 |
| DE | 14 76 074 | 3/1970 |
| DE | 26 60 387 | 4/1978 |
| DE | 27 57 668 | 7/1978 |
| DE | 37 19 469 | 12/1988 |
| DE | 41 31 275 | 3/1993 |
| DE | 100 22 035 | 11/2001 |
| DE | 100 28 926 | 12/2001 |
| DE | 10 2005 021 427.4 | 5/2005 |
| EP | 0 604 223 | 6/1994 |
| FR | 7 52 700 | 9/1933 |
| FR | 752 700 | 9/1933 |

* cited by examiner

TWO-PART PISTON FOR AN INTERNAL COMBUSTION ENGINE

CROSS REFERENCE TO RELATED APPLICATIONS

Applicant claims priority under 35 U.S.C. §119 of German Application No. 10 2005 041 409.5 filed Sep. 1, 2005. Applicant also claims priority under 35 U.S.C. §365 of PCT/DE2006/001527 filed Aug. 31, 2006. The international application under PCT article 21(2) was not published in English.

The invention relates to a two-part piston for an internal combustion engine, in accordance with the preambles of the main claim and of the secondary claims.

A two-part piston for an internal combustion engine, which consists of an upper part and a lower part, is known from the patent application having the file number 10 2005 021 427.4. The upper part forms the piston crown and has a cylindrical pin having an outside thread, which pin lies coaxial to the piston axis, on the underside facing away from the piston crown. The lower part has an upper, thin-walled, and elastically resilient crown part, at the central region of which a sleeve pointing in the direction of the piston crown is formed on, having walls that are so thin that this sleeve has the function of an expansion sleeve. An opening that lies coaxial to the piston axis is formed into this expansion sleeve, into which opening the pin is introduced, so that the upper part can be connected with the lower part by means of a nut screwed onto the pin, whereby the elastic resilience of the upper crown part and the expandability of the expansion sleeve puts the screw connection under bias, and thereby imparts great reliability to the latter.

It is disadvantageous that the production of the upper crown part of the lower part, with the expansion sleeve formed on, is very complicated. In this connection, time-consuming machining of the central region of the upper crown part and, in particular, of the expansion sleeve, is required, independent of whether the lower part is cast or forged, whereby attention must be paid to the adherence of close tolerances, so that the central region of the upper crown part and the expansion sleeve adhere to the desired elasticity properties.

Proceeding from this, the invention is based on the task of making the production of a two-part piston whose upper part and lower part are connected with one another by way of an expansion sleeve, simpler and less expensive.

This task is accomplished with the characteristics that stand in the characterizing part of the main claim and the secondary claims. Practical embodiments of the invention are the object of the dependent claims. In this connection, the advantage is obtained that a separate expansion sleeve can be produced in simpler and more cost-advantageous manner than a central region of the upper crown part re-functioned to become an expansion sleeve, and that the material used for this purpose can be of higher quality than the material of which the upper crown part of the lower part consists.

Figure 2:
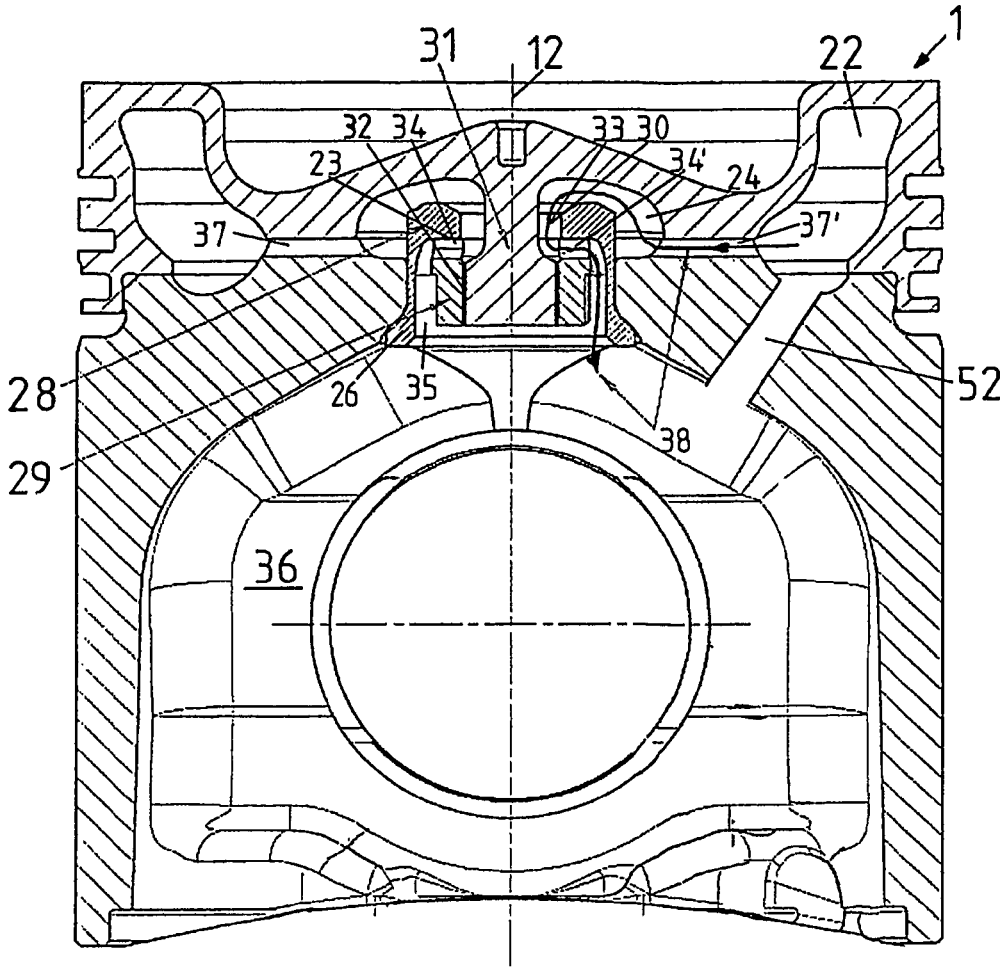
Figure 3:
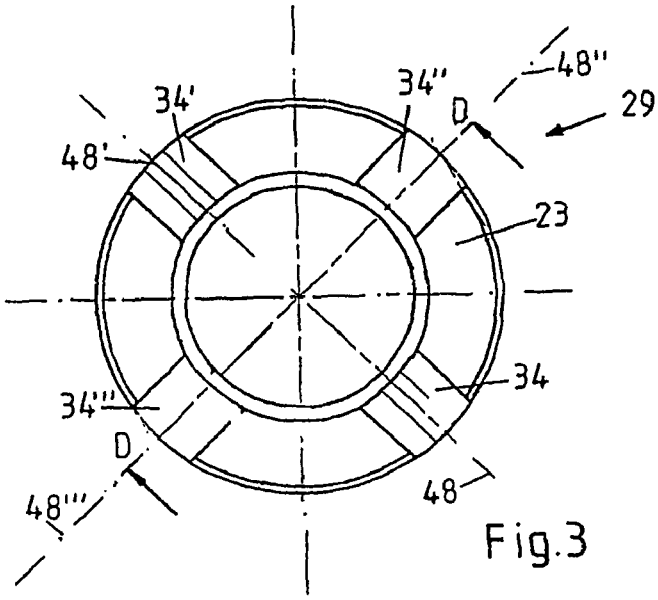
Figure 4:
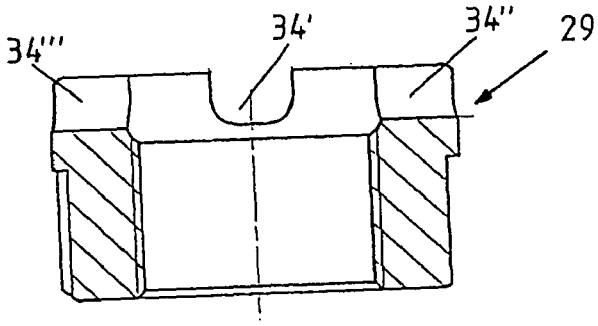
Figure 5:
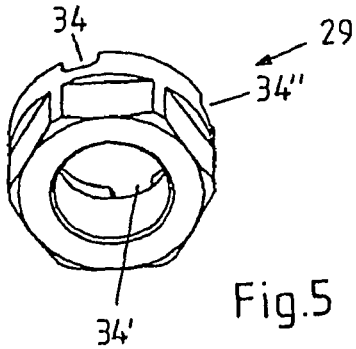
Figure 6:
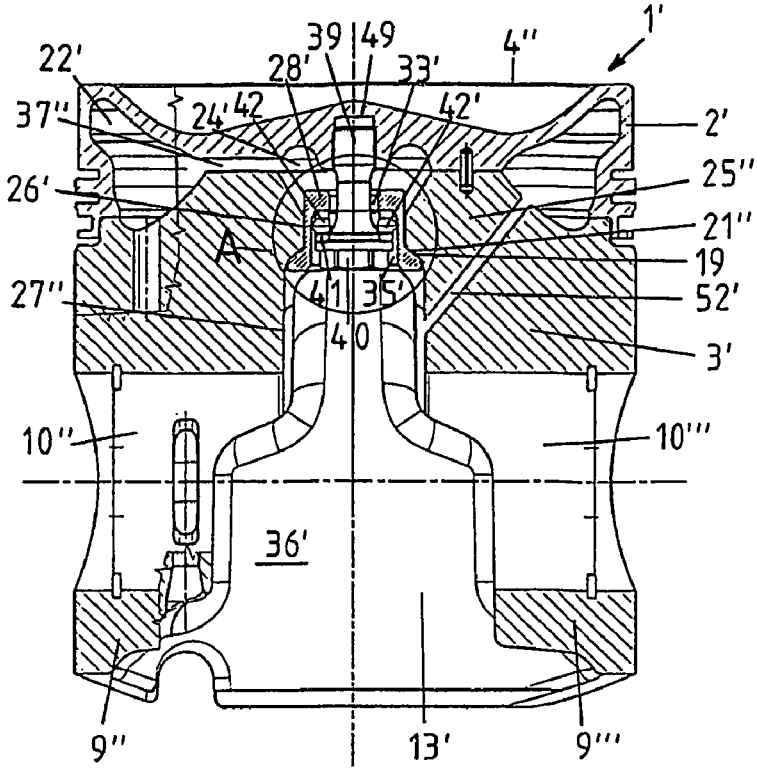
Figure 7:
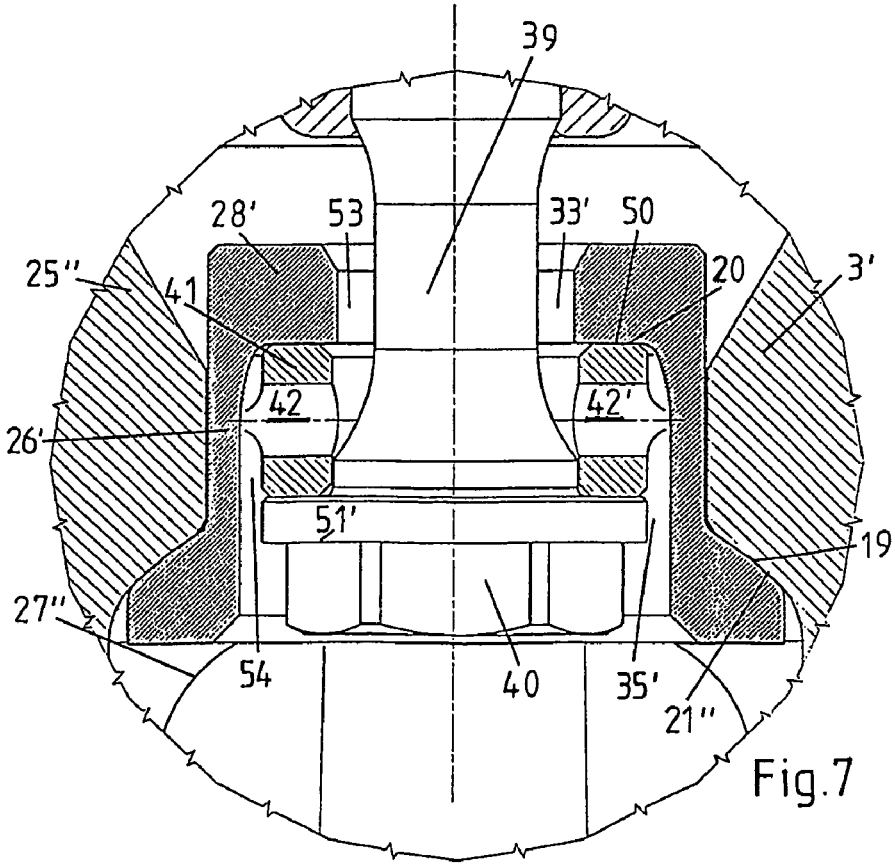
Figure 8:
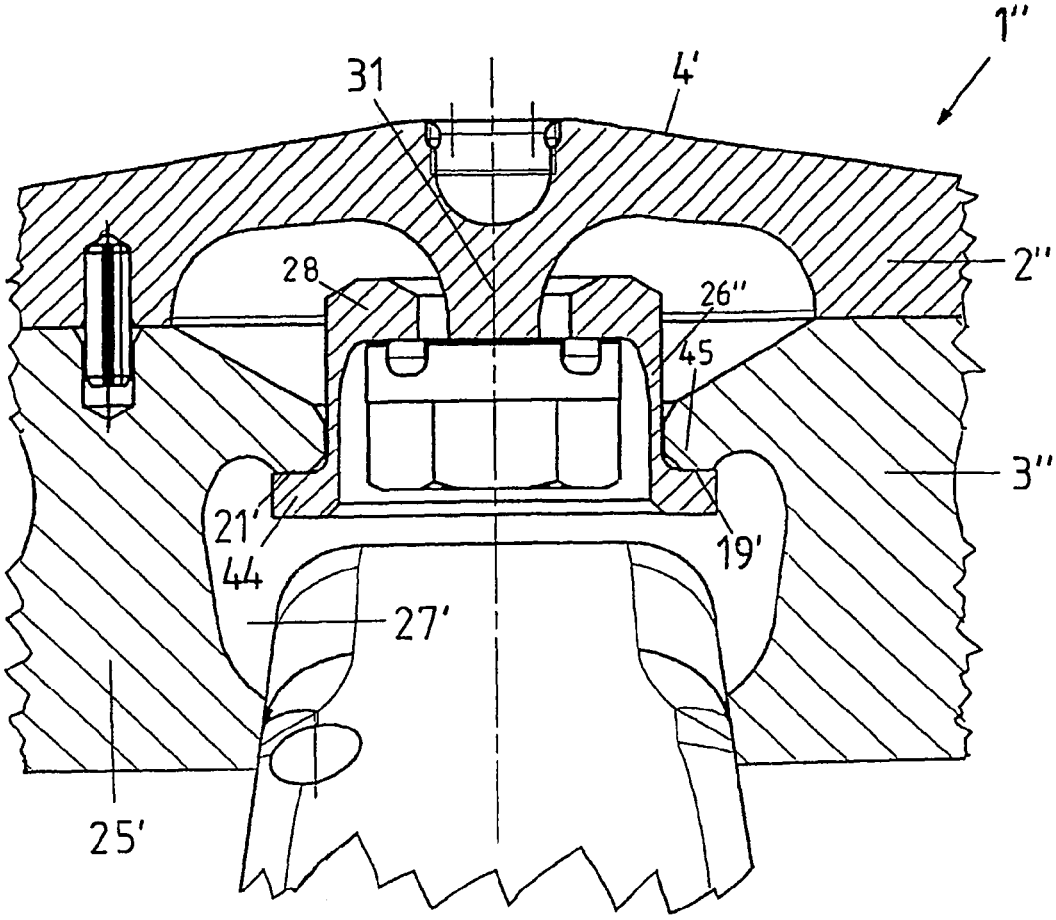
Figure 9:
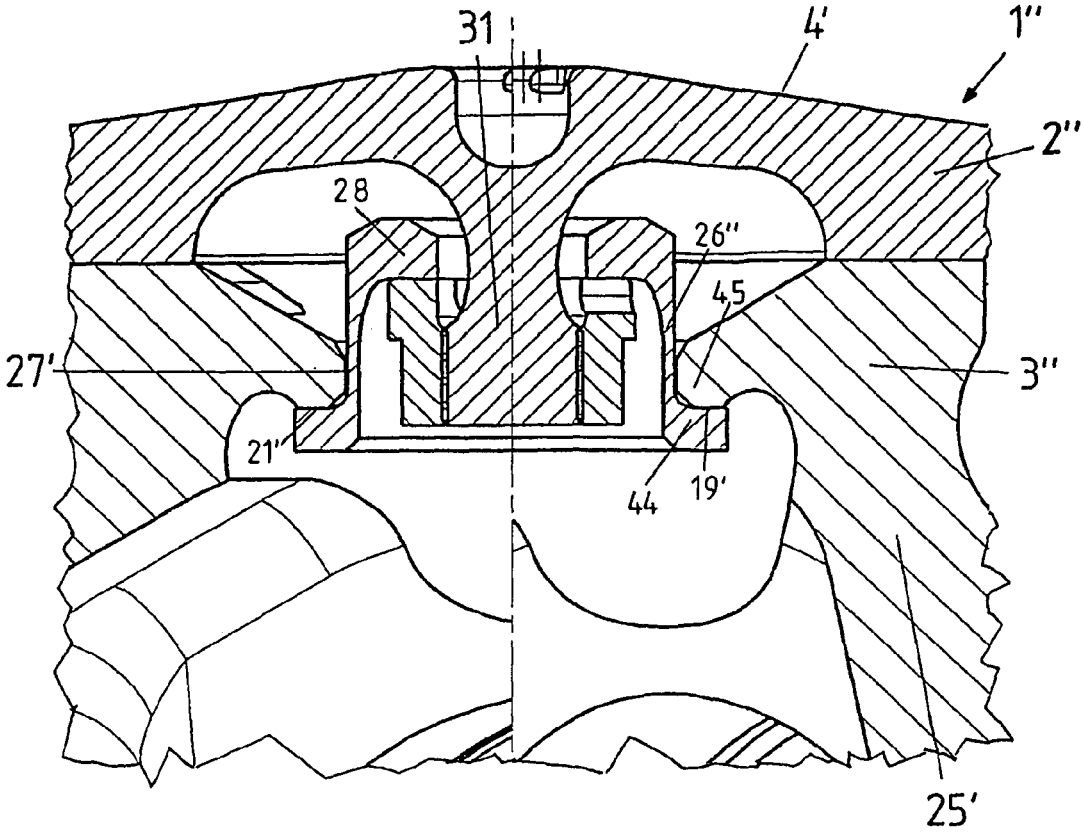

Some exemplary embodiments of the invention will be described below, using the drawing. This shows:

FIG. 1 a two-part piston whose two parts are connected with one another by way of an expansion sleeve, FIG. 2 a section through the piston according to FIG. 1, which allows the continuous cooling oil channel to be seen, FIG. 3 a top view of the nut used to screw the two parts of the piston together, FIG. 4 a section through the nut according to FIG. 3, FIG. 5 a perspective representation of the nut according to FIGS. 3 and 4, FIG. 6 an embodiment of the piston according to the invention, whereby a hexagonal screw is used to screw the two piston parts together, FIG. 7 an enlarged representation of the region A from FIG. 6, FIG. 8 an enlarged representation of another embodiment of the screw connection of the two piston parts, using an expansion sleeve, and FIG. 9 a representation in accordance with FIG. 8, with the hexagonal nut in section.

FIG. 1 shows a two-part, cooled piston 1 that consists of an upper part 2 and a lower part 3. The upper part 2 and the lower part 3 can be made from aluminum, steel, or cast iron with spheroidal graphite (GGG cast iron according to DIN 1693). A piston crown 4 delimits the axial upper side of the upper part 2, whose radially inner region has a combustion bowl 5. A ring wall 6 is formed into the outer edge of the piston crown 4, the outer surface of which belt forms a top land 7, followed on the skirt side by a ring belt 8 having ring grooves for accommodating piston rings not shown in the figure.

Two pin bosses 9, 9' each having a pin bore 10, 10' are disposed on the underside of the lower part 3, facing away from the piston crown 4. The pin bosses 9, 9' are connected with one another by way of skirt element 13.

The upper part 2 and the lower part 3 of the piston 1 are connected with one another by way of an inner contact surface 14 and by way of an outer contact surface 15 disposed concentric to the former. The upper part 2 and the lower part 3 each have a dead-end hole 16 and 17, which lie opposite one another when the upper and lower parts 2, 3 are positioned appropriately. A fixation pin 11 introduced into the two dead-end holes 16, 17 ensures that the upper part 2 and the lower part 3 always assume the same rotational position relative to one another.

An outer cooling channel 22 disposed in the edge region of the piston 1, on the piston crown side is formed by the upper part 2 and the lower part 3 of the piston 1, the radially outer limit of which channel is formed by the ring wall 6, the radially inner limit of which channel is formed partly by a lower part foot 18 disposed on the upper side of the lower part 3 and partly by the piston crown 4, and the axially lower limit of which is formed by the lower part 3 of the piston 1. Cooling oil is introduced into the cooling channel 22 by way of at least one oil feed channel 52 (FIG. 2).

The piston 1 has another, ring-shaped, inner cooling channel 24 disposed coaxial to the piston axis 12, which channel has a lesser radial diameter than the outer cooling channel 22, and which is disposed within the outer cooling channel 22, seen in the radial direction. Axially on the top, the inner cooling channel 24 is delimited by the piston crown 4, radially on the outside it is delimited by the lower part foot 18, axially on the bottom it is delimited by an upper crown part 25 of the lower part 3, and radially on the inside it is delimited by a pin 31, whereby the crown part 25 of the lower part 3 has an opening 27 radially on the inside.

The pin 31 is configured in cylindrical shape and formed onto the underside of the piston crown 4, coaxial to the piston axis 12, whereby the mantle surface of the pin 31 has an end region facing away from the piston crown, having an outside thread 32 (FIG. 2), which corresponds to the inside thread of the hexagonal nut 29, so that the hexagonal nut 29 can be screwed onto the outside thread 32.

The upper part 2 is screwed to the lower part 3 by means of the hexagonal nut 29, by way of an expansion sleeve 26 disposed between the upper face surface 23 of the hexagonal nut 29 and the upper crown part 25 of the lower part 3. For this purpose, the expansion sleeve 26 has a collar 28 directed inward on its end facing the piston crown, and a contact surface 19 that widens conically, radially toward the outside, in the direction facing away from the piston crown, at its end facing away from the piston crown.

When the upper part 2 and the lower part 3 are screwed together, the fixation pin 11 is first introduced into the dead-end hole 17 disposed in the upper crown part 25 of the lower part 3.

Subsequently, the upper part 2 and the lower part 3 are oriented coaxial to one another. For this purpose, the edge of the lower part 3, on the piston crown side, has a support crosspiece 46 that has the shape, in section, of a step directed radially inward and axially in the direction of the piston crown 4. Furthermore, a cylindrical recess 47 is formed into the inside of the lower face side of the ring wall 6, the inside shape of which recess is configured to be complementary to the outside shape of the support crosspiece 46. A coaxial orientation of upper part 2 and lower part 3 can thereby be achieved, in that the support crosspiece 46 is first introduced, at least partway, into the recess 47. In this connection, however, it is necessary to rotate the upper part 2 about the piston axis 12 until the dead-end hole 16 comes to lie above the fixation pin, after which the support crosspiece 46 can be introduced into the recess 47 in its entirety, and furthermore, the fixation pin 11 can be introduced into the dead-end hole 16.

Subsequently, the expansion sleeve 26 is pushed through the opening 27, and the hexagonal nut 29 is screwed onto the outside thread 32 of the pin 31. In this connection, the hexagonal nut 29 comes to rest against an inside surface 20 of the collar 28, facing away from the piston crown, by way of its upper face surface 23, and the contact surface 19 of the expansion sleeve 26 comes to rest against a surface 21 disposed on the radial inside of the opening 27, which surface opens conically downward. In this connection, the conicity of the surface 21 is at least approximately equal to the conicity of the contact surface 19. Then the hexagonal nut 29 is screwed tight with such a torque that because of the pressure of the hexagonal nut 29 onto the inside surface 20 of the collar 28 and because of the tensile stress exerted on the expansion sleeve 26 as a result, the expansion sleeve 26 undergoes an expansion that exerts a permanent bias on the screw connection, thereby imparting great reliability to this screw connection. Furthermore, the pin 31 undergoes expansion, in this connection, and the radially inner part of the piston crown 4 undergoes deformation in the manner of a disk spring, in the direction of the pin bosses 9, 9'. Furthermore, the expansion sleeve 26 is made from a high-quality steel material, thereby contributing to the reliability of the screw connection between upper part 2 and lower part 3 of the piston 1.

In this connection, the contact surface 19 on the side of the expansion sleeve 26 that faces away from the piston crown can also be configured to be spherical or ball-shaped, in an embodiment not shown in the figures, whereby the contact surface 21 of the upper crown part 25 of the lower piston part 3 that stands in contact with it can have a shape complementary to it.

As can be clearly seen in FIG. 2, the collar 28 delimits a circular opening 30, the radial diameter of which is greater than the radial diameter of the pin 31, so that a ring-shaped gap 33 occurs between pin 31 and collar 28. The hexagonal nut 29 has radially disposed grooves 34 and 34' in its upper face surface 23, which grooves open into the gap 33 radially on the inside. The radial inside diameter of the expansion sleeve 26 is greater than the radial outside diameter of the hexagonal nut 29, so that an interstice 35 in the shape of a cylinder and ring-shaped in section occurs between hexagonal nut 29 and expansion sleeve 26, the end of which interstice, on the side facing away from the piston crown, opens into the piston interior 36, and the end of which interstice, facing the piston crown, stands in connection with the grooves 34, 34'. Furthermore, the outer cooling channel 22 is connected with the inner cooling channel 24 by way of radially disposed overflow channels 37, 37'.

As indicated by the line 38, this results in a continuous oil channel, whereby first of all, cooling oil is introduced into the outer cooling channel 22 by way of the oil feed channel 52, which oil flows into the inner cooling channel 24 by way of the overflow channels 37, 37', and flows back into the piston interior 36 by way of the gap 33, by way of the grooves 34, 34', and by way of the interstice 35.

FIG. 3 shows a top view, FIG. 4 shows a sectional diagram, and FIG. 5 shows a perspective representation of the hexagonal nut 29 used to screw the upper part 2 to the lower part 3. In FIG. 3, an exemplary arrangement of the grooves 34 to 34''' is shown, whereby four grooves 34 to 34''' having radial longitudinal axes 48, 48', 48'', and 48''' are uniformly distributed over the circumference of the face surface 23, so that the longitudinal axis pairs 48-48'', 48''-48', 48'-48''', and 48'''-48 each enclose an angle of 90°.

FIG. 4 shows a section through the hexagonal nut 29 along the line DD in FIG. 3, with a representation of the U-shaped cross-section of the grooves, using the example of the groove 34', and with a top view of the flanks of the grooves 34'' and 34'''.

A perspective representation of the hexagonal nut 29 is shown in FIG. 5; in particular, the grooves 34, 34', and 34'' can be seen.

The embodiment of the present invention according to FIGS. 6 and 7 differs from the embodiment of the invention shown in FIG. 1 to 5 particularly in that the upper part 2' and the lower part 3' of the piston 1' are connected with one another by means of a hexagonal screw 39, whereby a tube-shaped intermediate piece 41 that is short in the axial direction and has one or more continuous, radially placed bores 42, 42' is disposed between the head 40 of the hexagonal screw 39 and the collar 28' of the expansion sleeve 26', by way of which bores the oil can flow from the gap 33' between the collar 28' of the expansion sleeve 26' and the shaft of the screw 39 into the interstice 35' between the expansion sleeve 26' and the screw head 40. From here, the oil gets into the piston interior 36'.

FIG. 7 is an enlarged representation of the region A from FIG. 6.

In FIG. 8, an embodiment of the piston 1'' is shown in partial section, and in FIG. 9, in full section, with an expansion sleeve 26'' that has a collar 28 directed radially inward on its end facing the piston crown, and a collar 44 directed radially outward on its end facing away from the piston crown. On the piston crown side, a radially oriented contact surface 19' is disposed on the collar 44. Furthermore, a cantilever 45 is formed onto the inside wall of the opening 27' in the upper crown part 25' of the lower piston part 3'', which cantilever narrows conically radially inward in the direction facing away from the piston crown, and is configured to be elastically resilient, and has a surface 21', also oriented radially, on its side facing away from the piston crown.

When the upper piston part 2'' is screwed together with the lower piston part 3'', the contact surface 19' comes to lie against the surface 21', whereby not only longitudinal expansion of the expansion sleeve 26'' and of the pin 31, and deformation of the center region of the piston crown 4', in the manner of a disk spring, in the direction of the piston skirt, but also deformation of the cantilever 45, in the manner of a disk spring, in the direction of the piston crown 4', occur. The deformations of the piston elements last mentioned lead to a bias that acts on the screw connection, which imparts great reliability to this connection.

REFERENCE SYMBOL LIST

1, 1', 1" piston
2, 2', 2" upper part
3, 3', 3" lower part
4, 4', 4" piston crown
5 combustion bowl
6 ring wall
7 top land
8 ring belt
9, 9', 9", 9'" pin boss
10, 10', 10", 10'" pin bore
11 fixation pin
12 piston axis
13, 13' skirt element
14 inner contact surface
15 outer contact surface
16, 17 dead-end hole
18 lower part foot
19, 19' contact surface
20 inner surface of collar 28
21, 21', 21" surface
22, 22' outer cooling channel
23 upper face surface of the hexagonal nut 29
24, 24' inner cooling channel
25, 25', 25" upper crown part of the lower part 3
26, 26', 26" expansion sleeve
27, 27', 27" opening
28, 28' collar
29 hexagonal nut
30 opening of the collar 28
31 pin
32 outside thread
33, 33' gap between the collar 28 and the pin 31
34, 34', 34", 34'" grooves of the hexagonal nut 29
35 interstice between the hexagonal nut 29 and the expansion sleeve 26
35' third interstice between the head 40 of the hexagonal screw 39 and the expansion sleeve 26'
36, 36' piston interior
37, 37', 37" overflow channel
38 line
39 hexagonal screw
40 head of the hexagonal screw 39
41 intermediate piece
42, 42' bore in the intermediate piece 41
43 expansion sleeve
44 collar
45 cantilever
46 support crosspiece
47 recess
48, 48', 48", 48'" longitudinal axes of the grooves 34, 34', 34", 34'"
49 dead-end hole bore
50 upper face surface of the intermediate piece 41
51 contact surface of the head 40 of the hexagonal screw 39
52, 52' oil feed channel
53 first interstice between the shaft of the hexagonal nut 29 and the intermediate piece 41
54 second interstice between the intermediate piece 41 and the expansion sleeve 26'

The invention claimed is:

1. Two-part piston (1, 1") for an internal combustion engine, having an upper part (2, 2") that forms a piston crown (4, 4'), whereby a cylindrical pin (31) having an outside thread (32) and lying coaxial to the piston axis (12) is formed onto the underside of the upper part (2, 2"), on the side facing away from the piston crown (4, 4"), and having a lower part (3, 3"), on the underside of which pin bosses (9, 9') having pin bores (10, 10') and skirt elements (13) that connected the pin bosses (9, 9') with one another are disposed, whereby the lower part (3, 3', 3") has an upper crown part (25, 25') with an opening (27, 27') that lies coaxial to the piston axis (12), into which opening the pin (31) is introduced, by way of which pin the upper part (2, 2") is screwed to the lower part (3, 3") by means of a hexagonal nut (29) screwed onto the pin (31), wherein the radial inside of the opening (27) has a ring-shaped surface (21) disposed on the skirt side, which lies further removed from the piston crown (4) than the upper face surface (23) of the hexagonal nut (29), and that an expansion sleeve (26) is disposed between the face surface (23) and the surface (21), which sleeve, for one thing, has a collar (28) directed radially inward, disposed on its side facing the piston crown, this collar having a radially oriented inside surface (20) on its side facing away from the piston crown, against which surface the face surface (23) of the hexagonal nut (29) rests, and, for another thing, has a contact surface (19) that faces the piston crown in its region that faces away from the piston crown, which surface rests against the surface (21).

2. Piston according to claim 1, wherein the contact surface (19) in the region of the expansion sleeve (26) facing away from the piston crown and the surface (21) on the radial inside of the opening (27) are configured to widen conically outward in the direction facing away from the piston crown.

3. Piston according to claim 1, wherein the contact surface (19) in the region of the expansion sleeve (26) facing away from the piston crown is configured to be spherical.

4. Piston according to claim 1, wherein the contact surface (19) in the region of the expansion sleeve (26) facing away from the piston crown is configured to be ball-shaped.

5. Piston according to claim 1, whereby the piston (1, 1") has a ring-shaped, outer cooling channel (22) in its edge region on the piston crown side, which channel is connected with the piston interior (36) by way of at least one oil feed channel (52), whereby the piston (1, 1") has a ring-shaped, inner cooling channel (24), within the outer cooling channel (22), disposed coaxial to the piston axis (12), delimited radially on the inside by the pin (31), which channel is connected with the outer cooling channel (22) by way of at least one overflow channel (37, 37'), and whereby a ring-shaped gap (33) is situated between the collar (28) of the expansion sleeve (26, 26") and the pin (31), wherein the hexagonal nut (29) has at least one radially disposed groove (34, 34', 34", 34'") in its upper face surface (23), which groove opens radially on the inside, into the gap (33), that an interstice (35) is situated between the hexagonal nut (29) and the expansion sleeve (26, 26"), the end of which interstice, on the piston crown side, stands in connection with the at least one groove (34, 34', 34", 34'"), that the end of the interstice (35) facing away from the piston crown opens into the piston interior (36), and that a continuous oil channel occurs, proceeding from the oil feed channel (52), by way of the outer cooling channel (22), by way of the at least one overflow channel (37, 37'), by way of the inner cooling channel (24), by way of the gap (33) between the collar (28) and the pin (31), by way of the at least one groove (34, 34', 34", 34'") in the face surface (23) of the hexagonal nut (29), and by way of the interstice (35) between the hexagonal nut (29) and the pin (31).

6. Piston according to claim 5, wherein the hexagonal nut (29) has four radially disposed grooves (34, 34', 34", 34'") distributed uniformly over its circumference, on its upper face surface (23).

7. Piston according to claim 1, wherein a collar (44) directed radially outward is disposed on the end of the expansion sleeve (26") facing away from the piston crown, which collar has a radially oriented contact surface (19') on the piston crown side, and that a cantilever (45) that narrows conically radially inward in the direction facing away from the piston crown and is elastically resilient is formed onto the inside wall of the opening (27'), which cantilever has a radially oriented surface (21') on its side facing away from the piston crown, against which surface the contact surface (19') rests.

* * * * *